US008720665B2

(12) United States Patent
Itou

(10) Patent No.: US 8,720,665 B2
(45) Date of Patent: May 13, 2014

(54) COIN FEEDING MACHINE AND COIN HANDLING MACHINE

(75) Inventor: Masashi Itou, Hyogo (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/519,435

(22) PCT Filed: Dec. 28, 2010

(86) PCT No.: PCT/JP2010/073719
§ 371 (c)(1),
(2), (4) Date: Jun. 27, 2012

(87) PCT Pub. No.: WO2011/081183
PCT Pub. Date: Jul. 7, 2011

(65) Prior Publication Data

US 2012/0295528 A1 Nov. 22, 2012

(30) Foreign Application Priority Data

Dec. 28, 2009 (JP) ..... 2009-296984

(51) Int. Cl.
*G07D 5/02* (2006.01)

(52) U.S. Cl.
USPC ..... 194/334; 194/336; 453/6; 453/10; 453/49; 453/57

(58) Field of Classification Search
USPC ..... 194/334–338; 453/6, 10, 12, 13, 33–35, 453/49, 57
See application file for complete search history.

(56) References Cited

U.S. PATENT DOCUMENTS

| | | | | |
|---|---|---|---|---|
| 5,285,883 | A * | 2/1994 | Le Hong et al. | 194/317 |
| 6,220,954 | B1 | 4/2001 | Nguyen et al. | |
| 6,612,921 | B2 * | 9/2003 | Geib et al. | 453/13 |
| 2006/0040604 | A1 * | 2/2006 | Wei | 453/34 |

(Continued)

FOREIGN PATENT DOCUMENTS

EP 1 544 805 A1 6/2005

(Continued)

OTHER PUBLICATIONS

European Search Report (Application No. 10841038.2—PCT/JP2010/073719) (6 pages—dated May 7, 2013).

*Primary Examiner* — Jeffrey Shapiro
(74) *Attorney, Agent, or Firm* — Renner, Kenner, Greive, Bobak, Taylor & Weber

(57) ABSTRACT

In a coin feeding machine 26 which uses a rotary disk 41 rotated at an inclined posture, a removal projection 59 for removing a smaller diameter coin is provided between a feeding projection 52 and a coin support portion 53 which are provided on a surface 41*a* of the rotary disk 41. The removal projection 59 is disposed to be positioned on the slightly outer side of the outer edge of a coin C when the coin C whose diameter is a lower limit value of a handling target range is brought into contact with the feeding projection 52 and the coin support portion 53. The side surface of the removal projection 59 is inclined relative to the surface of the rotary disk 41. When the coin is brought onto the inclined surface of this removal projection 59, the coin drops away from the surface 41*a* of the rotary disk 41. A coin C1 which is smaller than the lower limit value of the handling target range is brought onto the removal projection 59, so as to be dropped from the surface 41*a* of the rotary disk 41 and removed.

4 Claims, 6 Drawing Sheets

(56) References Cited

U.S. PATENT DOCUMENTS

| | | | | |
|---|---|---|---|---|
| 2009/0047888 | A1* | 2/2009 | Nishida | 453/3 |

FOREIGN PATENT DOCUMENTS

| | | | | |
|---|---|---|---|---|
| EP | 1 998 293 | A2 | 12/2008 | |
| JP | 61-152168 | | 9/1986 | |
| JP | 05-282515 | | 10/1993 | |
| JP | 2005-196731 | | 7/2005 | |
| WO | WO 2007/034699 | A1 | 3/2007 | |
| WO | WO 2007034699 | A1 * | 3/2007 | G07D 1/00 |

* cited by examiner

COIN FEEDING MACHINE AND COIN HANDLING MACHINE

TECHNICAL FIELD

The present invention relates to a coin feeding machine which feeds out coins one by one, and a coin handling machine which uses this coin feeding machine.

BACKGROUND ART

Conventionally, as a coin handling machine, there is a coin depositing and dispensing machine which cyclically uses deposit coins as dispense coins.

This coin depositing and dispensing machine has a transport path which transports the coins, and a feeding section and denomination-specific storing units connected to this transport path. At the time of depositing, the coins input from an inlet are received in the feeding section, the coins are fed out one by one from the feeding section to the transport path, and the coins are recognized in a recognition unit while being transported in the transport path and stored in the denomination-specific storing units in accordance with a result of recognition. At the time of dispensing, the coins are fed out one by one from the denomination-specific storing units to the transport path in accordance with a dispensing denomination, and the coins are transported in the transport path and dispensed to an outlet.

In the transport path, a transport belt is provided so as to move along this transport path, and projections are provided in this transport belt at predetermined intervals, so that the coins fed out one by one from the feeding section and the denomination-specific storing units are received between the projections, and the coins are transported while being pushed by the projections on the rear side in the transporting direction.

It is known that a coin feeding machine which uses an inclined rotary disk is used as the feeding section, the denomination-specific storing units, and the like. This coin feeding machine has a rotary disk which is rotated at an inclined posture in which the surface faces obliquely upward, and a cover which forms a storing unit which stores coins between the cover and the surface of this rotary disk, in which the coins in the storing unit are brought up one by one from a lower region of the rotary disk to an upper region upon rotation of the rotary disk, and fed out to a transport path (for example, refer to Patent Document 1).

The transport path and the like of the coin depositing and dispensing machine are optimally designed assuming that outer diameters of the coins are within a predetermined handling target range.

However, the coin feeding machine which uses the inclined rotary disk has a structure so that corresponding coins having various diameters can be fed out. Thus, even coins whose outer diameters are out of the handling target range are sometimes fed out to the transport path. For example, in a case where coins of Japanese yen are a handling target, the handling target range of the outer diameters is from 20 mm of a 1 yen coin to 26.5 mm of a 500 yen coin, and the coins whose outer diameters are within the handling target range can be fed out to the transport path. However, the coins whose outer diameters are out of the handling target range such as 16.25 mm of 1 Euro cent and 32 mm of 5 Swiss francs are sometimes also fed out to the transport path.

In such a way, when the coins whose outer diameters are out of the handling target range are fed out from the coin feeding machine to the transport path, the coins whose outer diameters exceed the assumed range cannot normally be transported in the transport path, so that a transport abnormality or the like is generated, and the coin handling machine is sometimes stopped by an error.

CITATION LIST

Patent Literature

PTL 1: International Publication No. WO2007/034699 (page 11 to page 15, FIG. 1 to FIG. 3)

SUMMARY OF INVENTION

Technical Problem

The present invention has been made in view of these circumstances, and an object thereof is to provide a coin feeding machine which can prevent feeding out of coins whose outer diameters are out of a handling target range, and a coin handling machine which uses this coin feeding machine.

Solution to Problem

A coin feeding machine of the present invention includes a rotary disk which is rotated at an inclined posture in which the surface faces obliquely upward, a cover which forms a storing unit which stores coins between the cover and the surface of the rotary disk, a feeding unit which protrudes from the surface of the rotary disk, supports the coins in the storing unit one by one upon rotation of the rotary disk, and moves the coins to an upper region of the rotary disk, a feeding guide which feeds out of the rotary disk, the coins whose outer diameters are within a handling target range among the coins moved to the upper region of the rotary disk by the feeding unit upon the rotation of the rotary disk, and a removal section which removes, from the feeding unit, the coins whose outer diameters are out of the handling target range among the coins moved to the upper region of the rotary disk by the feeding unit upon the rotation of the rotary disk, and drops the coins into the storing unit.

By the removal section, the coins whose outer diameters are out of the handling target range among the coins moved to the upper region of the rotary disk by the feeding unit upon the rotation of the rotary disk are removed from the feeding unit and dropped into the storing unit. Thus, feeding out of the coins whose outer diameters are out of the handling target range can be prevented.

With the coin feeding machine of the present invention, the removal section has a small-diameter removal unit which protrudes from the surface position of the rotary disk so as not to be in contact with the coins whose outer diameters are within the handling target range, the coins being moved to the upper region of the rotary disk by the feeding unit upon the rotation of the rotary disk but so as to contact with only the coins whose outer diameters are smaller than the handling target range, and removes the coins whose outer diameters are smaller than the handling target range from the feeding unit by contact with the coins.

Thereby, by the contact with the coins whose outer diameters are smaller than the handling target range, the coins can be reliably removed from the feeding unit.

With the coin feeding machine of the present invention, the removal section has a large-diameter removal unit which is disposed in a peripheral region of the rotary disk so as not to be in contact with the coins whose outer diameters are within the handling target range, the coins being moved to the upper region of the rotary disk by the feeding unit upon the rotation of the rotary disk but so as to contact with only the coins whose outer diameters are larger than the handling target range, and removes the coins whose outer diameters are larger than the handling target range from the feeding unit by contact with the coins.

Thereby, by the contact with the coins whose outer diameters are larger than the handling target range, the coins can be reliably removed from the feeding unit.

With the coin feeding machine of the present invention, the removal section has a hole portion which is provided at a position of the rotary disk to face the coins whose outer diameters are out of the handling target range moved to the upper region of the rotary disk by the feeding unit upon the rotation of the rotary disk, a removal member which is advanced to and retreated from the surface side of the rotary disk from the hole portion, and an advance and retreat mechanism which advances and retreats the removal member.

Thereby, the removal member is brought into contact with the coins whose outer diameters are out of the handling target range, so that the coins can be reliably removed from the feeding unit.

A coin handling machine of the present invention includes a transport path which transports coins while the coin feeding machine feeds out the coins to the transport path.

Advantageous Effects of Invention

According to the coin feeding machine of the present invention, feeding out of the coins whose outer diameters are out of the handling target range can be prevented.

According to the coin handling machine of the present invention, feeding out of the coins whose outer diameters are out of the handling target range from the coin feeding machine to the transport path can be prevented, so that generation of an error can be reduced.

DESCRIPTION OF EMBODIMENTS

Hereinafter, one embodiment of the present invention will be described with reference to the drawings.

Figure 6:
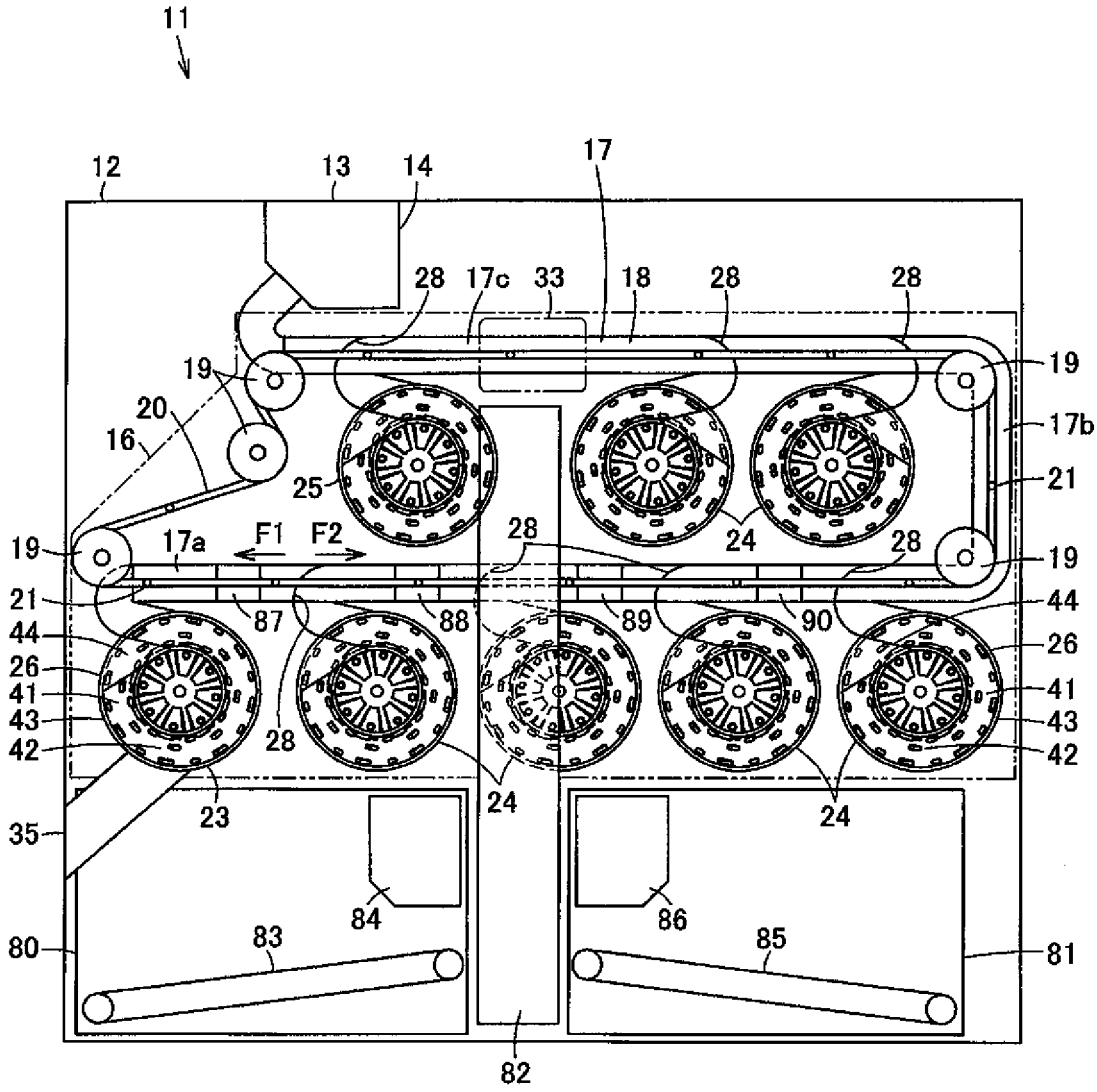
FIG. 6 is a configuration diagram in which the coin handling machine is viewed from the side surface.
Figure 7:
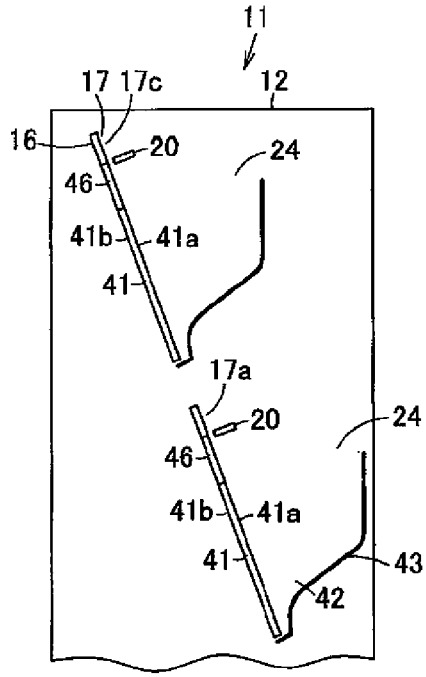
FIG. 7 is a sectional view in which the coin handling machine is viewed from the front surface.

As shown in FIGS. 6 and 7, a coin depositing and dispensing machine which deposits and dispenses coins is shown as a coin handling machine 11. This coin handling machine 11 has a machine body 12, and a transaction port 13 which functions as an inlet to deposit the coins and an outlet to dispense the coins is formed on the front side (the left side in FIG. 6 indicates the front side) at the upper portion of this machine body 12. A shutter (not shown) is disposed in this transaction port 13 so as to open and close.

On the lower side of the transaction port 13, a receiving portion 14 which receives and stores the coins is disposed. This receiving portion 14 receives the coins such as deposited coins input from the outside of the machine body 12 into the transaction port 13, and receives the coins such as dispensed coins or returned coins dispensed from an interior of the machine body 12 to the transaction port 13. Part of the bottom surface of this receiving portion 14 can be opened and closed, so that the coins can be ejected downward by opening the part.

On the upper portion side in the machine body 12, a flat plate shape base 16 is disposed at an inclined posture in which the upper portion relative to the vertical direction is inclined toward the back surface side, and the surface faces obliquely upward (inclined posture in which the upper portion relative to the vertical direction is inclined toward the left side which serves as the back surface side, and the surface faces obliquely upward on the right when viewed from the front surface of the machine body 12 as shown in FIG. 7). On the surface of this base 16, a transport path 17 which transports the coins in a state that the coins are separated one by one is disposed. This transport path 17 is provided with a path portion 18 which includes a path surface to guide the faces of the coins to be transported and a path wall to guide peripheral edges of the coins, and a transport belt 20 which serves as a transport body supported by a plurality of pulleys 19 so as to move along on this path portion 18.

The transport belt 20 is extended by the plurality of pulleys 19 in a state that a gap is provided between the transport belt and the path portion 18 so as to receive the coins, and a plurality of transport projections 21 which serves as coin retaining portions is provided to project from the face which faces the path portion 18 at predetermined intervals in the belt longitudinal direction. By rotating the pulleys 19 of the transport belt 20 by a motor (not shown), the transport belt 20 moves on the path portion 18, the coins are received one by one between this path portion 18 and the transport belt 20 and between the transport projections 21 adjacent to each other in the belt longitudinal direction, and the coins are transported in the transporting direction while being pushed by the transport projections 21 on the rear side in the transporting direction.

The transport path 17 is provided with a first transport path portion 17*a* provided in the front-rear direction of the machine body 12, a second transport path portion 17*b* connected to the rear end of this first transport path portion 17*a*, and a third transport path portion 17*c* provided in the front-rear direction at the above position of the first transport path portion 17*a* and connected to the second transport path portion 17*b* at the rear end. The front end of the third transport path portion 17*c* is connected to the transaction port 13, so that the coins can be transported from the front end of the third transport path portion 17*c* to the receiving portion 14. Hereinafter, the direction of transporting the coins from the third transport path portion 17*c* toward the second transport path portion 17*b* and the first transport path portion 17*a* is called the storage transporting direction (first transporting direction) F1. Conversely, the direction of transporting the coins from the first transport path portion 17*a* toward the second transport path portion 17*b* and the third transport path portion 17*c* is called the dispensing transporting direction (second transporting direction) F2.

A feeding section 23 is connected to the front end of the first transport path portion 17*a* of the transport path 17, a plurality of denomination-specific storing/feeding units 24 is connected to the first transport path portion 17*a* on the rear side of the feeding section 23 and to the third transport path portion 17*c*, and an escrow unit 25 is connected to the third transport path portion 17*c* on the front side of the denomination-specific storing/feeding units 24. The feeding section 23, the denomination-specific storing/feeding units 24, and the escrow unit 25 are formed by coin feeding machines (coin storing/feeding machines) 26 having basically the same configuration.

Guide mechanisms 28 are disposed in the transport path 17 corresponding to the connection positions of the feeding section 23, the denomination-specific storing/feeding units 24, and the escrow unit 25. The guide mechanisms 28 are selectively switched in accordance with a case where the coins to be input/output between the feeding section 23, the denomination-specific storing/feeding units 24, and the escrow unit 25, and the transport path 17 are guided, or a case where the coins transported in the transport path 17 are caused to pass to the downstream side in the transporting direction.

Figure 3:
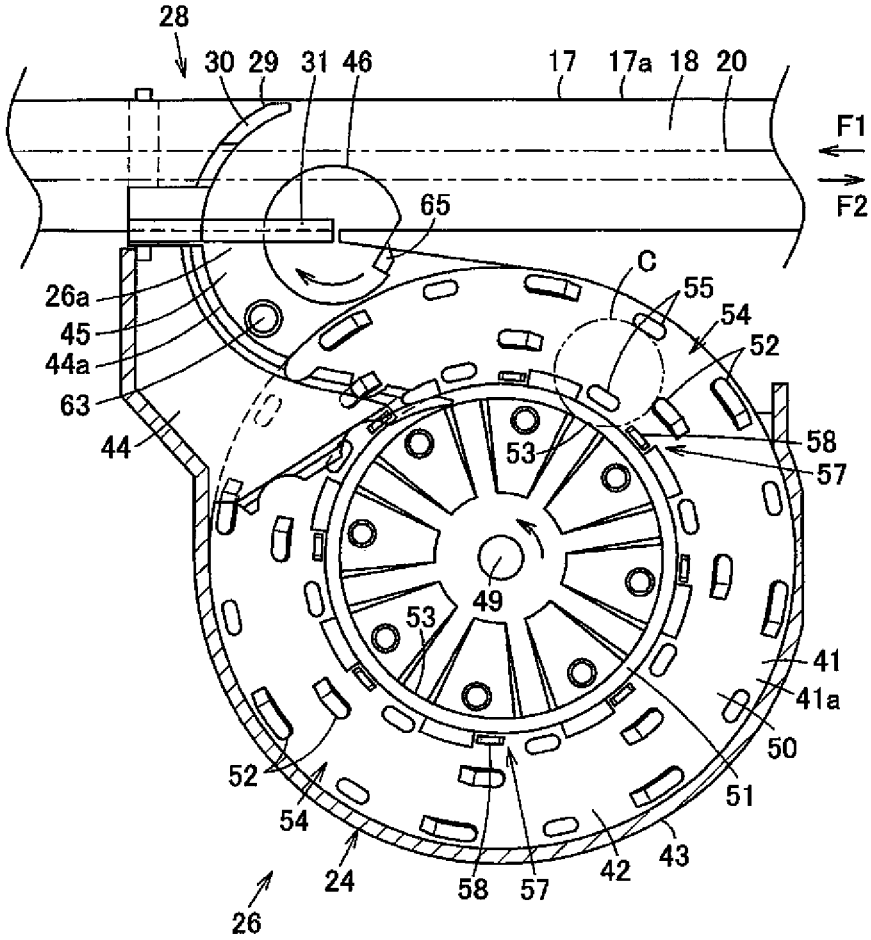
FIG. 3 is a front view showing part of the coin feeding machine and a transport path.

FIG. 3 shows the guide mechanism 28 of the denomination-specific storing/feeding unit 24 of the first transport path portion 17*a*. This guide mechanism 28 is provided with a guide member 29 which is advanced to and retreated from the transport path 17, and this guide member 29 is provided with a guide portion 30 which guides the coins to a gateway 26*a* of the denomination-specific storing/feeding unit 24 opened at the lower side position of the transport path 17, and a closing portion 31 which closes the gateway 26*a* and guides the coins to the downstream side in the transporting direction. This guide member 29 advances and retreats on the transport path 17 by drive of a solenoid or the like. When the coins are distributed from the transport path 17 to the denomination-specific storing/feeding unit 24, and when the coins are fed out from the denomination-specific storing/feeding unit 24 to the transport path 17, the guide portion 30 protrudes in the transport path 17, and the closing portion 31 moves to the coin storing/dispensing position to open the gateway 26*a*. When the coins are not distributed from the transport path 17 to the denomination-specific storing/feeding unit 24, and when the coins are not fed out from the denomination-specific storing/feeding unit 24 to the transport path 17, the guide portion 30 retreats to the outside of the transport path 17, and the closing portion 31 moves to the coin passing position to close the gateway 26*a*.

As shown in FIG. 6, a recognition unit 33 which recognizes at least denominations, authenticity, and fitness, etc., of coins being transported is disposed between the denomination-specific storing/feeding unit 24 and the escrow unit 25 of the third transport path portion 17*c*.

It should be noted that a chute (not shown) which guides the coins ejected from the receiving portion 14 to the feeding section 23 is disposed between the receiving portion 14 and the feeding section 23. The feeding section 23 can discharge and return foreign material input together with the deposited coins to a return port 35 provided on the front surface of the machine body 12.

Next, the coin feeding machine 26 will be described with reference to FIGS. 1 to 7.

In this coin feeding machine 26, coins C whose outer diameters are within a handling target range (it should be noted that although the reference numeral C denotes the coins in the description of the coin feeding machine 26, the reference numeral C of the coins will be omitted in other descriptions) are fed out to the transport path 17, and coins C1 out of the handling target range are not fed out to the transport path 17 in the coin handling machine 11. For example, in a case where coins of Japanese yen are a handling target, the handling target range of the outer diameters is from 20 mm of a 1 yen coin to 26.5 mm of a 500 yen coin.

The coin feeding machine 26 is provided with a rotary disk 41 which is rotated at an inclined posture in which the upper portion relative to the vertical direction is inclined toward the back surface 41*b* side so as to be parallel to the surface side of the base 16, and a surface 41*a* faces obliquely upward (refer to FIG. 7), a cover 43 which forms a storing unit 42 which stores the coins C between the cover and the surface 41*a* side of this rotary disk 41, a feeding guide 44 which is disposed so as to face an upper region of the surface 41*a* of the rotary disk 41, and guides the coins C fed out from the rotary disk 41 toward the transport path 17, a curved guiding path 45 in which the coins C fed out from the upper region of the rotary disk 41 to the transport path 17 by this feeding guide 44 pass, a delivery disk 46 which is disposed over this guiding path 45 and the transport path 17, a restricting guide 47 which is disposed so as to face this delivery disk 46, and the like.

First, as shown in FIGS. 1 to 4, the rotary disk 41 is rotatable around a rotary axis 49, and a coin contact surface 50 which has a radial size larger than a diameter of one coin whose outer diameter is within the handling target range and smaller than the diameters of two coins, and so as to contact with the coin surface of the coin C is formed in a peripheral region of the surface 41*a*, and an annular groove portion 51 is formed on the inner circumferential side of this coin contact surface 50.

A plurality of feeding projections 52 which is brought into contact with the peripheral edge of one coin C whose coin surface is brought into contact with the coin contact surface 50 in the storing unit 42 and picks the coin up to the upper region of the rotary disk 41 is disposed on the coin contact surface 50 in the radial direction, so as to have a predetermined gap larger than the diameter of the coin whose outer diameter is within the handling target range in the circumferential direction. Projection size of the feeding projections 52 from the surface 41*a* of the rotary disk 41 (the coin contact surface 50) is smaller than the thickness of the thinnest coin to be a handling target so that only one coin C is caught in the thickness direction. The tip end surfaces of the feeding projections which face the feeding rotating direction (the counterclockwise direction of FIGS. 1 to 4) are formed in curved surfaces, and the surfaces on the opposite rear end side are formed in inclined surfaces which stand up from the surface 41*a* of the rotary disk 41 in an inclination state.

In the inner circumferential side of the groove portion 51, a plurality of coin support portions 53 which supports the peripheral edge lower portion side of the coin C picked up to the upper region of the rotary disk 41 by the feeding projections 52 is disposed in the circumferential direction so as to correspond to the positions of the feeding projections 52. Projection size of the coin support portions 53 from the surface 41*a* of the rotary disk 41 (the coin contact surface 50) is smaller than the thickness of the thinnest coin to be the handling target so that only one coin C is mounted in the thickness direction. Regarding the size between the coin support portion 53 and the outer peripheral edge of the rotary disk 41, radial size is larger than the diameter of one coin whose outer diameter is within the handling target range and smaller than the diameters of two coins so that only one coin C is mounted.

The feeding projections 52 and the coin support portions 53 form a feeding unit 54 which supports the coins C in the storing unit 42 one by one upon rotation of the rotary disk 41, moves the coins to the upper region of the rotary disk 41, and feeds out the coins from the upper region of the rotary disk 41 toward the transport path 17 in cooperation with the feeding guide 44.

On the coin contact surface 50 of the rotary disk 41, a plurality of sensor hole portions 55 for detecting the remaining coins C in the storing unit 42 by a remaining coin detection sensor (not shown) is formed corresponding to the positions of the feeding projections 52 and the coin support portions 53.

The coin feeding machine 26 is provided with a removal section 57 which removes, from the feeding unit 54, the coins C1 whose outer diameters are out of the handling target range among the coins C moved to the upper region of the rotary disk 41 by the feeding unit 54 upon the rotation of the rotary disk 41, and drops the coins into the storing unit 42.

Figure 1:
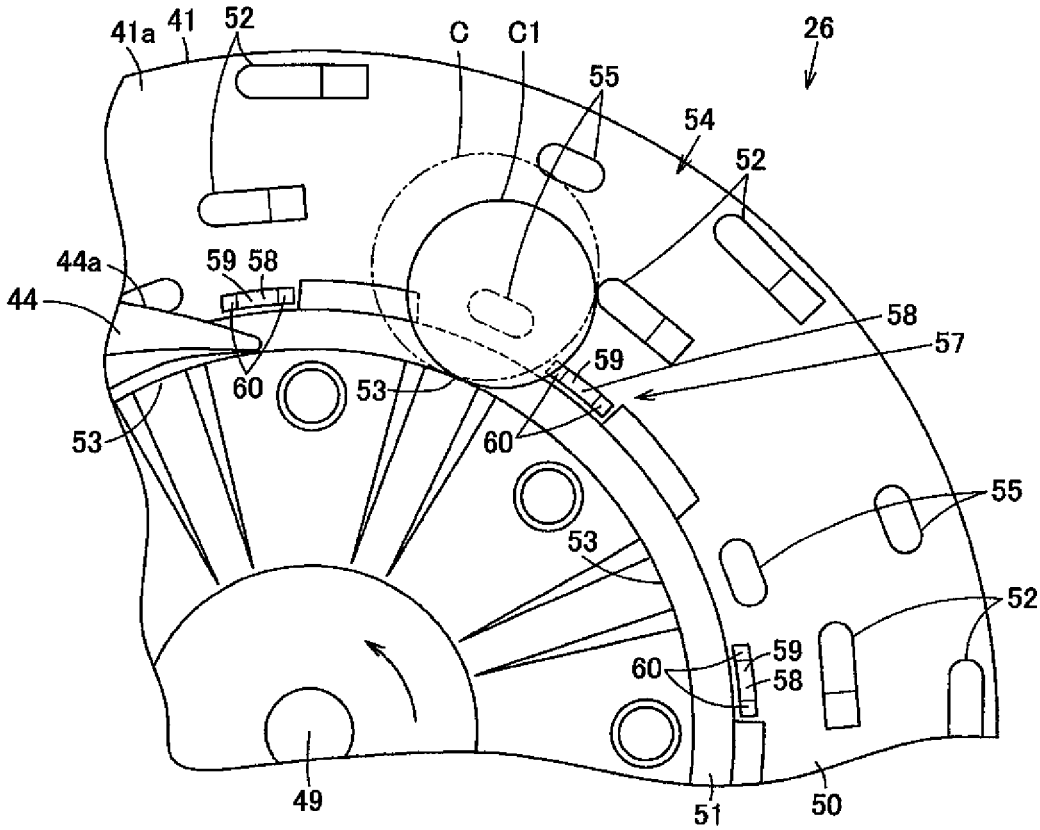
FIG. 1 is a front view of part of a coin feeding machine showing a first embodiment of the present invention.
Figure 2:
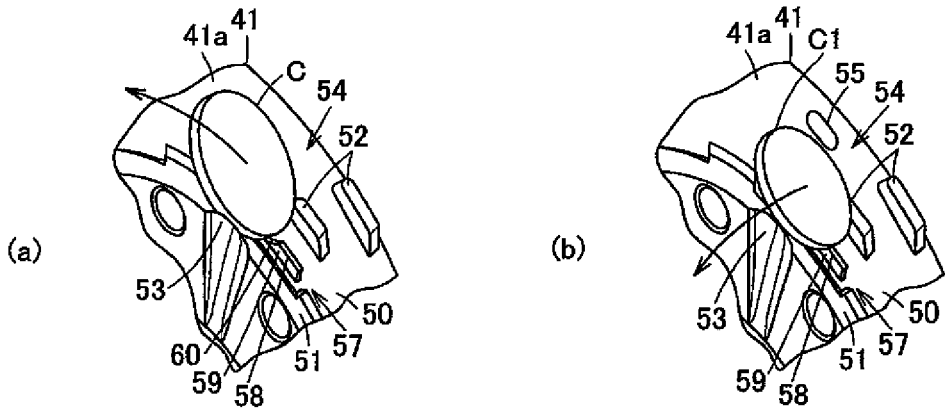
FIG. 2 show a feeding operation by the coin feeding machine, FIG. 2(*a*) is a perspective view of part in a case where coins whose outer diameters are within a handling target range are fed out, and FIG. 2(*b*) is a perspective view of the part in a case where coins whose outer diameters are smaller out of the handling target range are removed.

This removal section 57 has a plurality of small-diameter removal units 58 which remove the coins C1 whose outer diameters are smaller than the coins C within the handling target range. As shown in FIGS. 1 and 2, each of the small-diameter removal units 58 is a removal projection 59 which protrudes from the surface 41*a* of the rotary disk 41 (the coin contact surface 50) between the feeding projection 52 on the respective inner circumferential side and the coin support portion 53 in line on the further inner circumferential side of the feeding projection 52 on the inner circumferential side, and contact surfaces 60 which stand up as inclined surfaces or recessed arc surfaces from the surface 41*a* of the rotary disk 41 are formed in the tip end which faces the feeding rotating direction of the rotary disk 41 and the rear end on the opposite side thereof.

The contact surface 60 on the tip end side of the small-diameter removal unit 58 is disposed at the position on the outer side of the peripheral edge position of the coin C whose peripheral edge is brought into contact with and supported by both the feeding projection 52 and the coin support portion 53 and whose outer diameter is within the handling target range, so as not to be in contact with the coin C, and at the position on the inner side of the peripheral edge position of the smaller diameter coin C1 if the peripheral edge of the smaller diameter coin C1 whose outer diameter is smaller than the handling target range is brought into contact with and supported by both the feeding projection 52 and the coin support portion 53, so as to be in contact with the smaller diameter coin before the peripheral edge of the smaller diameter coin C1 is in contact with one of the feeding projection 52 on the inner circumferential side and the coin support portion 53 is brought into contact with the other of the feeding projection 52 on the inner circumferential side and the coin support portion 53. That is, the small-diameter removal unit 58 is disposed so that a diameter of an imaginary circle in contact with the feeding projection 52, the coin support portion 53, and the tip end side of the small-diameter removal unit 58 becomes the same as a lower limit of the diameter of the coin C within the handling target range or slightly smaller than the lower limit.

Therefore, the coin C1 whose outer diameter is a smaller than the handling target range is not brought into contact with and supported by both the feeding projection 52 on the inner circumferential side and the coin support portion 53 but brought into contact with the feeding projection 52 on the inner circumferential side or the coin support portion 53 and the contact surface 60 on the tip end side of the small-diameter removal unit 58. By contact with the contact surface 60 on the tip end side of the small-diameter removal unit 58, the coin floats up from the surface 41*a* of the rotary disk 41 and falls down to the storing unit 42.

Figure 4:
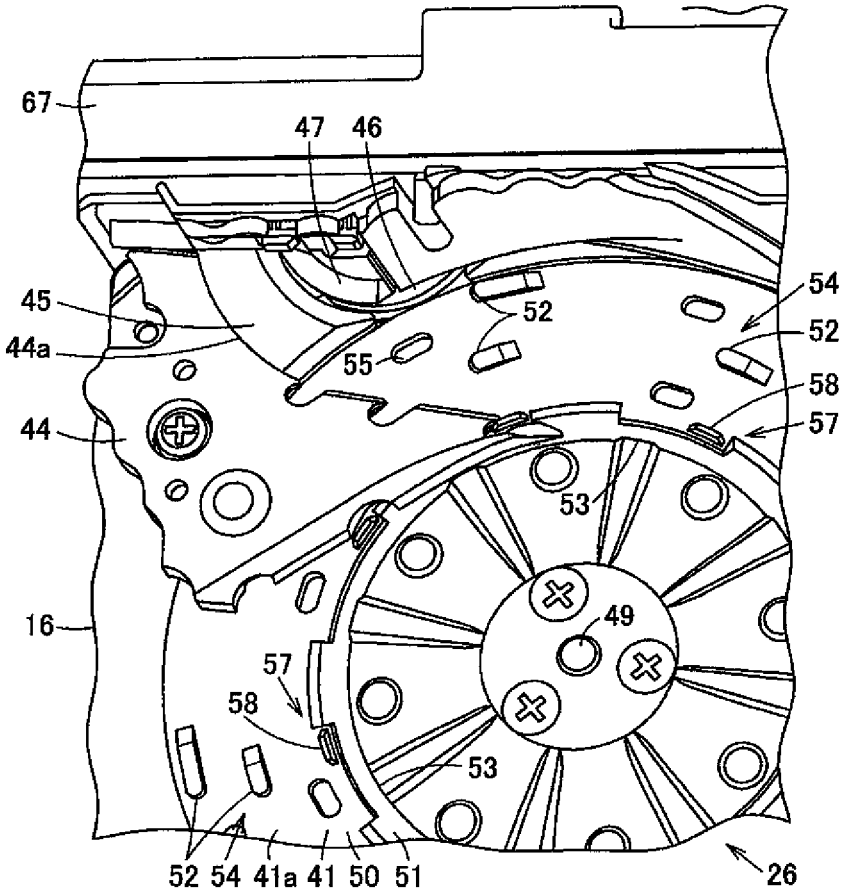
FIG. 4 is a perspective view of part of the coin feeding machine.

As shown in FIGS. 3 and 4, the feeding guide 44 is disposed so as to face the coin contact surface 50 of the rotary disk 41 and have a gap into which the coin C does not come between the feeding guide and the coin contact surface. On the back surface of the feeding guide 44 which faces the coin contact surface 50 of the rotary disk 41, a groove portion (not shown) through which the respective feeding projections 52 and the small-diameter removal units 58 can pass upon the rotation of the rotary disk 41 is formed. The tip end of the feeding guide 44 is disposed in a state so as to come into the groove portion 51 of the rotary disk 41, and a guide edge portion 44*a* which guides the coin C while curving toward the transport path 17 above is formed in the upper edge which continues from this tip end of the feeding guide 44.

The path surface of the guiding path 45 is formed to be flush with the surface 41*a* of the rotary disk 41 (the coin contact surface 50) and the path surface of the transport path 17, and the guiding path provides connection between the upper region of the rotary disk 41 and the gateway 26*a* opened in the transport path 17. In this guiding path 45, a restricting unit 63 which moves integrally with the guide member 29 and protrudes from or sinks into the path surface of the guiding path 45 is disposed. This restricting unit 63 sinks into the path surface of the guiding path 45 and permits passage of the coin C when the closing portion 31 of the guide member 29 is in an open state, and protrudes from the path surface of the guiding path 45 and drops the coin C which comes into the guiding path 45 into the storing unit 42 when the closing portion 31 moves to the closing position.

The delivery disk 46 is rotatably disposed at the position over the guiding path 45 and the transport path 17 so that the surface of the delivery disk 46 is flush with the surface 41*a* of the rotary disk 41 (the coin contact surface 50) and the path surface of the transport path 17. In the peripheral portion of the delivery disk 46, a projecting portion 65 which is abutted with the peripheral edge of the coin C and feeds out the coin while pushing from the rotary disk 41 side to the transport path 17 is provided to project. The delivery disk 46 is rotated and driven in conjunction with the rotary disk 41. When the rotary disk 41 is rotated in the feeding rotating direction (the counterclockwise direction of FIGS. 3 and 4), this delivery disk 46 is also rotated in the feeding rotating direction (the clockwise direction of FIGS. 3 and 4), and the peripheral edge of the coin C sent into the guiding path 45 along the feeding guide 44 while being pushed by the feeding projection 52 of the rotary disk 41 is abutted with the projecting portion 65 and fed out to the transport path 17.

Figure 5:
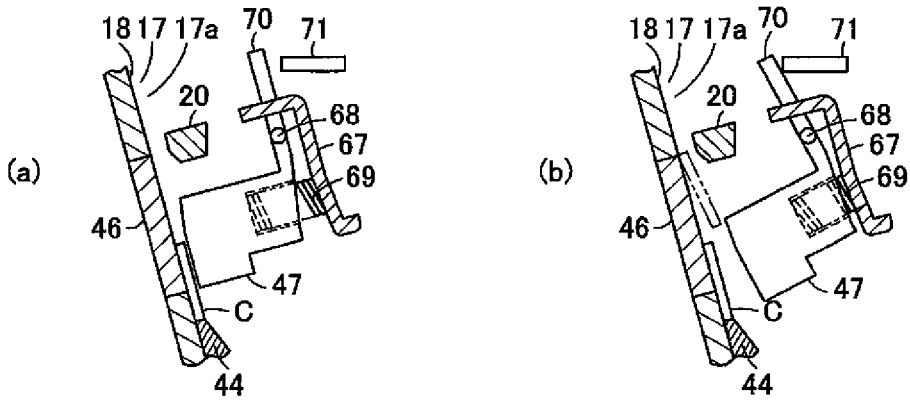
FIG. 5 show a restricting guide of the coin feeding machine, FIG. 5(*a*) is a sectional view showing a switching state at the time of feeding out the coins, and FIG. 5(*b*) is a sectional view showing a switching state at the time of receiving the coins.

As shown in FIGS. 4 and 5, the restricting guide 47 is disposed at the position so as to face the surface of the delivery disk 46, oscillatably and axially supported by an axis 68 so that a gap from the surface of the delivery disk 46 is changed with respect to the support member 67 disposed on the surface of the base 16, and pushed in the direction in which the gap from the surface of the delivery disk 46 is decreased by the spring force of a spring 69. A lever portion 70 protrudes in the upper portion of the restricting guide 47, and a link 71 which moves by drive of a solenoid (not shown) abuts with this lever portion 70.

As shown in FIG. 5(*a*), at the time of feeding out the coins C from the coin feeding machine 26 to the transport path 17, the solenoid for the restricting guide is not operated, the link 71 does not push the lever portion 70 of the restricting guide 47, and the restricting guide 47 is pushed by the spring 69 so that the gap through which one coin C passes is maintained between the guiding path 45 and the surface of the delivery disk 46. Thereby, feeding out of the two overlapping coins C from the coin feeding machine 26 to the transport path 17 can be reliably prevented. As shown in FIG. 5(*b*), at the time of receiving the coins C from the transport path 17 to the coin feeding machine 26, the solenoid for the restricting guide is operated, the lever portion 70 of the restricting guide 47 is pressed by the link 71 against pushing of the spring 69, and the restricting guide 47 is brought away from the surface of the delivery disk 46, so that the gap is extended. Thereby, the coins C which are sent from the transport path 17 to the guiding path 45 easily come in between the guiding path 45 and the restricting guide 47, and can be reliably received and stored in the coin feeding machine 26.

It should be noted that as shown in FIG. 6, the respective coin feeding machines 26 of the feeding section 23, the denomination-specific storing/feeding units 24, and the escrow unit 25 are formed to merely have the opposite directions due to a difference in the transporting direction or a difference in a function to handle the coins C between the first transport path portion 17*a* and the third transport path portion 17*c* but have the same basic configurations.

In the feeding section 23, projection height from the surface 41*a* of the rotary disk 41 of the feeding projections 52 and the coin support portions 53 is set to be lower than the denomination-specific storing/feeding units 24 and the escrow unit 25.

Next, as shown in FIG. 6, in the lower portion in the machine body 12, an overflow stacking unit 80 which stores overflow coins which cannot be stored in the denomination-specific storing/feeding units 24 is disposed and a coin cassette 81 which stores replenished coins and collected coins is also disposed. Between the overflow stacking unit 80 and the coin cassette 81, a transport mechanism 82 which transports the coins fed out from the overflow stacking unit 80 and the coin cassette 81 to the escrow unit 25 above is disposed.

In the overflow stacking unit 80, a belt 83 which feeds out the coins to the transport mechanism 82, and a collection cassette 84 which collects forgotten-to-be-taken coins in the receiving portion 14 are disposed. In the coin cassette 81, a belt 85 which feeds out the coins to the transport mechanism 82, and a reject box 86 which collects the rejected coins are disposed.

The first transport path portion 17*a* is provided with a diversion portion 87 which diverts the overflow coins to the overflow stacking unit 80, a diversion portion 88 which diverts the forgotten-to-be-taken coins to the collection cassette 84, a diversion portion 89 which diverts the rejected coins to the reject box 86, and a diversion portion 90 which diverts the collected coins to the coin cassette 81.

Next, an operation of the coin handling machine Irwin be described.

First, a handling operation of the entire coin handling machine 11 will be described with reference to FIG. 6.

At the time of handling deposit, the shutter of the transaction port 13 is opened, the coins input from the transaction port 13 are received into the receiving portion 14, the shutter of the transaction port 13 is closed, and then the coins in the receiving portion 14 are ejected to the feeding section 23 below through the chute (not shown).

The coins in the feeding section 23 are fed out one by one to the transport path 17, transported in the transport path 17 toward the dispensing transporting direction F2, and recognized in the recognition unit 33. The coins recognized as authentic are distributed from the transport path 17 to the escrow unit 25 and escrowed. The coins not recognized as authentic are sent from the transport path 17 to the receiving portion 14, and can be taken out from the receiving portion 14 by opening the shutter (not shown) of the transaction port 13.

When the deposit is approved after handling of escrow or return of all the coins input to the transaction port 13 is completed, the coins in the escrow unit 25 are stored in the denomination-specific storing/feeding units 24. When the deposit is cancelled, the coins in the escrow unit 25 are returned.

That is, in a case where the deposit is approved, the coins in the escrow unit 25 are fed out one by one to the transport path 17, transported in the transport path 17 toward the storage transporting direction F1, recognized in the recognition unit 33, and distributed to and stored in the denomination-specific storing/feeding unit 24 of the corresponding denomination based on a result of recognition. The coins of the denomination whose denomination-specific storing/feeding unit 24 is full are not stored in the denomination-specific storing/feeding unit 24 but diverted from the transport path 17 in the diversion portion 87 and stored in the overflow stacking unit 80.

In a case where the deposit is cancelled, the coins in the escrow unit 25 are fed out one by one to the transport path 17, transported in the transport path 17 in the storage transporting direction F1, and stored in the feeding section 23. After all the coins in the escrow unit 25 are moved to the feeding section 23, the coins in the feeding section 23 are fed out one by one to the transport path 17, transported in the transport path 17 toward the dispensing transporting direction F2, and sent from the transport path 17 into the receiving portion 14. The coins can be taken out from the receiving portion 14 by opening the shutter of the transaction port 13.

The coin feeding machine 26 adopted as the feeding section 23, the denomination-specific storing/feeding units 24, and the escrow unit 25 supports and feeds out the coins one by one with both the feeding projections 52 and the coin support portions 53. Thus, there is sometimes a case where, for example, deformed coins and the like are not supported by the feeding projections 52 and the coin support portions 53 so as not to be easily fed out. In this case, when the deformed coins which are mixed in the coins input from the outside are coincidentally fed out from the feeding section 23 and sent into the escrow unit 25 and the denomination-specific storing/feeding units 24, the deformed coins cannot be fed out from the escrow unit 25 and the denomination-specific storing/feeding units 24, and the coin handling machine 11 is sometimes stopped by an error. Therefore, in the coin handling machine 11 of the present embodiment, the projection height from the surface 41*a* of the rotary disk 41 of the feeding projections 52 and the coin support portions 53 in the feeding section 23 is set to be lower than the denomination-specific storing/feeding units 24 and the escrow unit 25, so that the deformed coins are not easily fed out from the feeding section 23. Thereby, error stoppage of the coin handling machine 11 when the deformed coins are sent into the escrow unit 25 and the denomination-specific storing/feeding units 24 can be prevented, so that the deformed coins which remain in the feeding section 23 can be returned to the return port 35 which is provided on the front surface of the machine body 12.

At the time of handling dispensing, the coins in the denomination-specific storing/feeding unit 24 of the denomination to be dispensed are fed out one by one to the transport path 17, transported in the transport path 17 in the dispensing transporting direction F2, and recognized in the recognition unit 33. The coins recognized as authentic are sent from the transport path 17 into the receiving portion 14, and the coins not recognized as authentic are distributed from the transport path 17 to the escrow unit 25 and escrowed.

In a case where the coins not recognized as authentic are sent into the escrow unit 25, dispensing of the coins from the denomination-specific storing/feeding unit 24 is completed. After the coins to be dispensed are sent into the receiving portion 14, the coins in the escrow unit 25 are fed out one by one to the transport path 17, transported in the transport path 17 in the storage transporting direction F1, and recognized in the recognition unit 33. The coins recognized as authentic by re-recognition are stored in the corresponding denomination-specific storing/feeding unit 24, and the coins not recognized as authentic again by the re-recognition are diverted in the diversion portion 89 of the transport path 17 and stored in the reject box 86.

When the coins to be dispensed are sent into the receiving portion 14, the coins can be taken out from the receiving portion 14 by opening the shutter of the transaction port 13.

In a case where a sensor (not shown) detects that the coins remain on the receiving portion 14 even after a predetermined time elapses after the shutter of the transaction port 13 is opened, the coins are determined as the forgotten-to-be-taken coins and the forgotten-to-be-taken coins are collected. That is, after the shutter of the transaction port 13 is closed, the forgotten-to-be-taken coins in the receiving portion 14 are ejected to the feeding section 23 below. After the forgotten-to-be-taken coins in the feeding section 23 are fed out one by one to the transport path 17, transported in the transport path 17 toward the dispensing transporting direction F2, and recognized in the recognition unit 33, the forgotten-to-be-taken coins are escrowed in the escrow unit 25. After the denomination and the number of the forgotten-to-be-taken coins are confirmed, the coins are fed out one by one from the escrow unit 25 to the transport path 17, transported in the transport path 17 in the storage transporting direction F1, diverted in the diversion portion 88 of the transport path 17, and stored in the collection cassette 84.

At the time of handling replenishing, the coins stored in the overflow stacking unit 80 or the coin cassette 81 are fed out to the transport mechanism 82, and transported to the escrow unit 25 by the transport mechanism 82. The coins in the escrow unit 25 are fed out one by one to the transport path 17, transported in the transport path 17 toward the storage transporting direction F1, recognized in the recognition unit 33, and distributed to and stored in the denomination-specific storing/feeding unit 24 of the corresponding denomination based on a result of recognition. The coins of the denomination whose denomination-specific storing/feeding unit 24 is full are not stored in the denomination-specific storing/feeding unit 24 but diverted from the transport path 17 in the diversion portion 87 and stored in the overflow stacking unit 80.

Next, an operation of the coin feeding machine 26 will be described with reference to FIGS. 1 to 5.

In order to feed out the coins C stored in the storing unit 42 between the surface 41*a* of the rotary disk 41 and the cover 43, the rotary disk 41 and the delivery disk 46 are rotated in the feeding rotating direction.

The coins in the storing unit 42 are agitated by the rotating rotary disk 41, and one coin C comes in between the feeding projections 52 adjacent to each other in the rotating direction of the rotary disk 41, and between the coin support portion 53 and the cover 43, and the surface of one coin C is brought into contact with the coin contact surface 50, so that the coin C is picked up to the upper region of the rotary disk 41 in a state that the feeding projection 52 on the rear side in the rotating direction (the upstream side in the rotating direction) relative to the coin C is abutted with the peripheral edge of the coin C.

When the coin C is moved to the upper region of the rotary disk 41, as shown by a double chain line of FIG. 1 and FIG. 2(*a*), while the peripheral edge of the coin C is abutted with the feeding projection 52, the coin C is lowered and moved toward the center side of the rotary disk 41 by gravity, and brought into contact with and mounted onto the coin support portion 53, and the peripheral edge of the coin C is in a state brought into contact with and supported by both the feeding projection 52 and the coin support portion 53. That is, in a case where the outer diameter of the coin C is within the handling target range, the coin is in a state not brought into contact with the small-diameter removal unit 58 but brought into contact with and supported by both the feeding projection 52 and the coin support portion 53.

When the coin C brought into contact with and supported by both the feeding projection 52 and the coin support portion 53 reaches the feeding guide 44, the peripheral edge of the coin C is brought onto the feeding guide 44, and by being continuously pushed by the feeding projection 52, pushed out from the rotary disk 41 to the guiding path 45 along the guide edge portion 44*a* of the feeding guide 44.

By pushing out the coin C from the rotary disk 41 to the guiding path 45, the projecting portion 65 of the delivery disk 46 rotated in the guiding path 45 is brought into contact with the coin C, and this projecting portion 65 receives the coin C from the feeding projection 52 and feeds out the coin to the transport path 17 while continuously pushing.

In the transport path 17, the transport belt 20 is rotated in synchronization with the rotary disk 41 and the delivery disk 46 of the coin feeding machine 26, and the coin C fed out from the coin feeding machine 26 is received between the transport projections 21 of the transport belt 20 and transported.

In a case where the smaller diameter coins C1 whose outer diameters are out of the handling target range are mixed in the storing unit 42, and upon the rotation of the rotary disk 41, one smaller diameter coin C1 comes in between the feeding projections 52 adjacent to each other in the rotating direction of the rotary disk 41, and between the coin support portion 53 and the cover 43, and the surface of one smaller diameter coin C1 is brought into contact with the coin contact surface 50, as well as the coin C whose outer diameter is within the handling target range, the smaller diameter coin C1 is picked up to the upper region of the rotary disk 41 in a state that the feeding projection 52 on the rear side in the rotating direction (the upstream side in the rotating direction) relative to the smaller diameter coin C1 is abutted with the peripheral edge of the smaller diameter coin C1.

When the smaller diameter coin C1 is moved to the upper region of the rotary disk 41, as shown by a solid line of FIG. 1 and FIG. 2(*b*), while the peripheral edge of the smaller diameter coin C1 is abutted with the feeding projection 52, the smaller diameter coin C1 is lowered and moved toward the center side of the rotary disk 41 by gravity. However, the peripheral edge of the smaller diameter coin C1 is brought into contact with and brought onto the contact surface 60 of the small-diameter removal unit 58 before being abutted with the coin support portion 53, the lower portion side of the smaller diameter coin C1 floats up from the surface of the rotary disk 41, and the smaller diameter coin C1 is not brought into and supported by the coin support portion 53 but dropped into the storing unit 42 below, so that the smaller diameter coin C1 is not fed out.

In such a way, by the small-diameter removal units 58 of the removal section, the smaller diameter coins C1 whose outer diameters are out of the handling target range among the coins C moved to the upper region of the rotary disk 41 by the feeding unit 54 upon the rotation of the rotary disk 41 are removed from the feeding unit 54 and dropped into the storing unit 42, so that feeding out of the smaller diameter coins C1 whose outer diameters are out of the handling target range can be prevented.

The small-diameter removal unit 58 protrudes from the surface position of the rotary disk 41 so as not to be in contact with the coins C whose outer diameters are within the handling target range, the coins being moved to the upper region of the rotary disk 41 by the feeding unit 54 upon the rotation of the rotary disk 41 but so as to contact with only the smaller diameter coins C1 whose outer diameters are out of the handling target range, so that the smaller diameter coins C1 can be reliably removed from the feeding unit 54 by contact with the smaller diameter coins C1, feeding out can be reliably prevented, and the small-diameter removal unit can be realized with a simple structure.

Therefore, according to the coin handling machine 11, feeding out of the smaller diameter coins C1 whose outer diameters are out of the handling target range from the coin feeding machine 26 to the transport path 17 can be prevented, so that generation of an error can be reduced.

In a case where the smaller diameter coins C1 are not fed out but left in the feeding section 23 to which the coin feeding machine 26 is applied, by opening a discharge port (not shown) provided in the lower portion of the cover 43 of this feeding section 23, the smaller diameter coins C1 can be discharged and returned to the return port 35 provided on the front surface of the machine body 12, so that handling can be continued without stopping the coin handling machine 11 by an error.

At the time of feeding out the coins from the coin feeding machine 26, in a case where the coins are the deformed coins or the number of the coins is small in particular one, the coins in the storing unit 42 are flipped by the feeding projections 52 of the rotating rotary disk 41 or the like, so that the coins are abruptly moved in the bottom portion of the storing unit 42, the coins are not caught by the feeding projections 52, and the coins are sometimes not fed out. The sensor (not shown) detects that the coins are not fed out from the coin feeding machine 26 through the sensor hole portions 55 of the rotary disk 41.

In such a case, after the rotation of the rotary disk 41 is once stopped, a retry operation for rotating the rotary disk 41 reversely to the feeding rotating direction and then rotating the rotary disk 41 in the feeding rotating direction is performed according to need. In a case where the coins are not fed out even when the retry operation is performed a plurality of times, the rotation speed of rotating the rotary disk 41 in the feeding rotating direction is slowed down to be less than a normal condition and the rotary disk is slowly rotated, so that the coins are easily caught by the feeding projections 52, and the coins can be reliably fed out from the coin feeding machine 26.

In this case, in accordance with the slowing of the rotation speed of the rotary disk 41, the rotation speed of the delivery disk 46 and the rotation speed of the transport belt 20 are synchronously slowed down.

Figure 8:
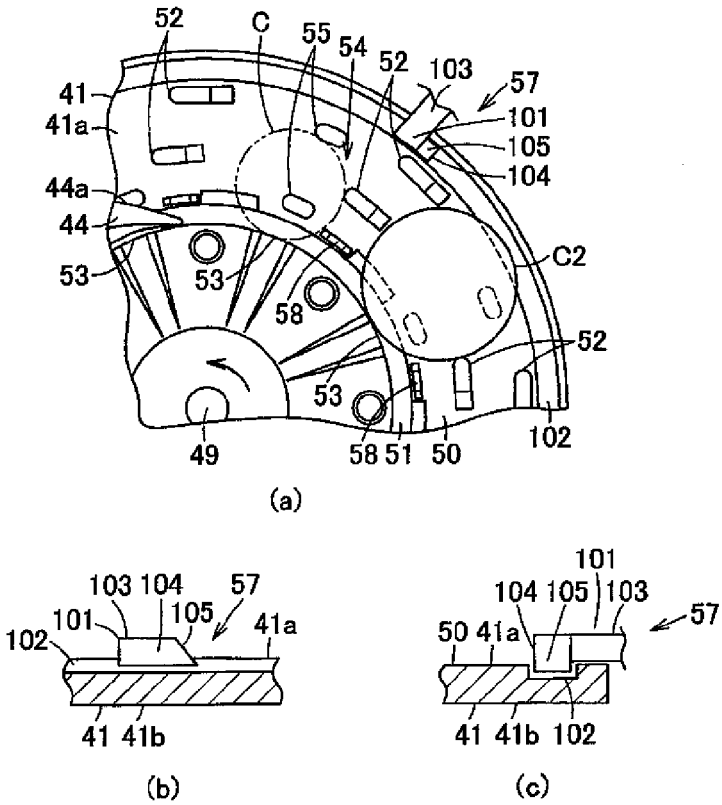
FIG. 8 are the coin feeding machine showing a second embodiment of the present invention, FIG. 8(*a*) is a front view of part of the coin feeding machine, FIG. 8(*b*) is an enlarged sectional view of the part viewed from the radial direction of the coin feeding machine, and FIG. 8(*c*) is an enlarged sectional view of the part viewed from the circumferential direction of the coin feeding machine.

Next, FIG. 8 show a second embodiment.

The removal section 57 has a large-diameter removal unit 101 which removes larger diameter coins C2 whose outer diameters are larger than the coins C within the handling target range in addition to the small-diameter removal units 58. This large-diameter removal unit 101 is provided with an annular groove portion 102 which is formed in the vicinity of the peripheral portion of the surface 41*a* of the rotary disk 41, and a removal member 103 which utilizes the groove portion 102 in the upper region of the rotary disk 41 and removes the larger diameter coins C2.

The groove portion 102 is formed at the position where a radial distance from the coin support portion 53 is larger than the outer diameter size of the coins C within the handling target range and includes the outer diameter size of the larger diameter coins C2 out of the handling target range.

The removal member 103 is attached to the fixing part of the base 16 or the like, the tip end is disposed so as to face the upper region of the surface 41*a* of the rotary disk 41, a removal unit 104 which comes into the groove portion 102 is formed on the tip end thereof, and a contact surface 105 which is the inclined surface which stands up from the bottom position in the groove portion 102 to the surface position of the removal member 103 is formed on the end surface of the removal unit 104 which faces the feeding rotating direction of the rotary disk 41.

In a case where upon the rotation of the rotary disk 41, one coin C whose outer diameter is within the handling target range comes in between the feeding projections 52 adjacent to each other in the rotating direction of the rotary disk 41, and between the coin support portion 53 and the cover 43, and the surface of one coin C is brought into contact with the coin contact surface 50, the coin C is picked up to the upper region of the rotary disk 41 in a state that the feeding projection 52 on the rear side in the rotating direction (the upstream side in the rotating direction) relative to the coin C is abutted with the peripheral edge of the coin C.

When the coin C is moved to the upper region of the rotary disk 41, while the peripheral edge of the coin C is abutted with the feeding projection 52, the coin C is lowered and moved toward the center side of the rotary disk 41 by gravity, and brought into contact with and mounted onto the coin support portion 53, and the peripheral edge of the coin C is in a state brought into contact with and supported by both the feeding projection 52 and the coin support portion 53. Thereby, the peripheral edge of the coin C is positioned on the inner circumferential side of the groove portion 102 of the rotary disk 41 and passes on the inner circumferential side of the removal member 103 of the large-diameter removal unit 101 so as to be normally fed out.

In a case where the larger diameter coin C2 whose outer diameter is out of the handling target range is mixed in the storing unit 42, and upon the rotation of the rotary disk 41, one larger diameter coin C2 comes in between the feeding projections 52 adjacent to each other in the rotating direction of the rotary disk 41, and between the coin support portion 53 and the cover 43, and the surface of one larger diameter coin C2 is brought into contact with the coin contact surface 50, as well as the coin C whose outer diameter is within the handling target range, the larger diameter coin C2 is picked up to the upper region of the rotary disk 41 in a state that the feeding projection 52 on the rear side in the rotating direction (the upstream side in the rotating direction) relative to the larger diameter coin C2 is abutted with the peripheral edge of the larger diameter coin C2.

When the larger diameter coin C2 is moved to the upper region of the rotary disk 41, the peripheral edge of the larger diameter coin C2 is lowered and moved toward the center side of the rotary disk 41 by gravity. Even when the peripheral edge is abutted with and mounted onto the coin support portion 53, the upper portion side of the peripheral edge of the larger diameter coin C2 is positioned on the trajectory to be abutted with the removal member 103 of the large-diameter removal unit 101 on the groove portion 102.

Therefore, the peripheral edge of the larger diameter coin C2 is abutted with and brought onto the contact surface 105 of the removal unit 104 of the removal member 103, the upper portion side of the larger diameter coin C2 floats up from the surface of the rotary disk 41, and the larger diameter coin C2 is brought away from the feeding projection 52 and the coin support portion 53 and dropped into the storing unit 42 below, so that the larger diameter coin C2 is not fed out.

In such a way, the large-diameter removal unit 101 is disposed in a peripheral region of the rotary disk 41 so as not to be in contact with the coins C whose outer diameters are within the handling target range, the coins being moved to the upper region of the rotary disk 41 by the feeding unit 54 upon the rotation of the rotary disk 41 but so as to contact with only the larger diameter coins C2 whose outer diameters are out of the handling target range, so that the coins C2 can be reliably removed from the feeding unit 54 by contact with the larger diameter coins C2, and the large-diameter removal unit can be realized with a simple structure.

According to the coin handling machine 11, feeding out of the larger diameter coins C2 whose outer diameters are out of the handling target range from the coin feeding machine 26 to the transport path 17 can be prevented, so that generation of an error can be reduced.

It should be noted that the groove portion 102 of the rotary disk 41 may have a groove shape which is opened on the peripheral surface of the rotary disk 41.

Figure 9:
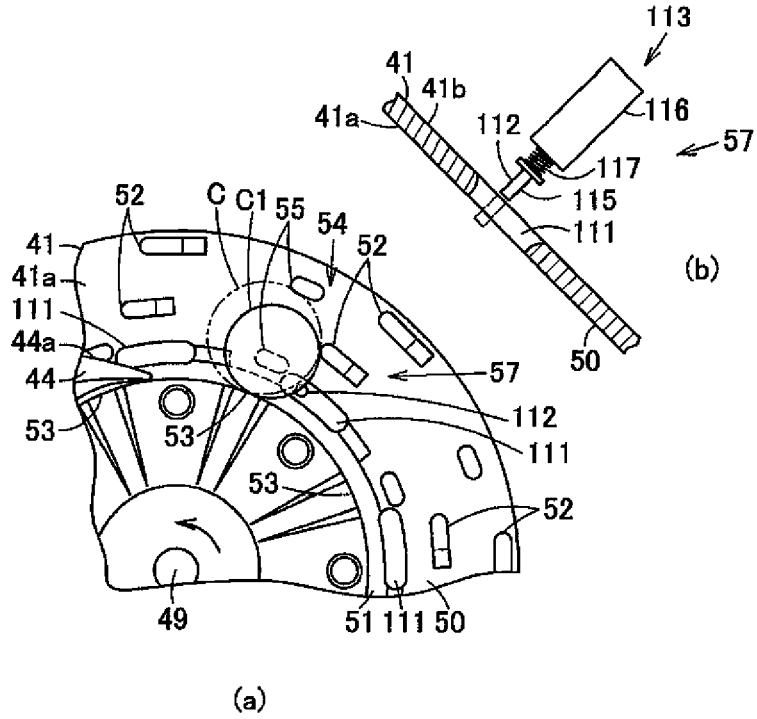
FIG. 9 are the coin feeding machine showing a third embodiment of the present invention, FIG. 9(*a*) is a front view of part of the coin feeding machine, and FIG. 9(*b*) is a sectional view in which part of the coin feeding machine is disposed at the position where the part is developed relative to the front view of FIG. 9(*a*)

Next, FIG. 9 shows a third embodiment.

The removal section 57 has a plurality of hole portions 111 which is provided to penetrate through the rotary disk 41, a removal member 112 which is advanced to and retreated from the back surface 41*b* side of the rotary disk 41 to the surface 41*a* side through the hole portions 111, and an advance and retreat mechanism 113 which advances and retreats this removal member 112, as the small-diameter removal unit 58.

Each of the hole portions 111 is formed between the feeding projection 52 on the respective inner circumferential side and the respective coin support portion 53, includes a region on the outer side of the peripheral edge position of the coin C whose peripheral edge is brought into contact with and supported by both the feeding projection 52 and the coin support portion 53 and whose outer diameter is within the handling target range, and on the inner side of the peripheral edge position of the coin C1 which is brought into contact with and supported by both the feeding projection 52 and the coin support portion 53 and whose outer diameter is a smaller than the handling target range, and is formed in a long hole elongated in the circumferential direction of the rotary disk 41 with the region placed in the middle.

The removal member 112 is formed by a columnar pin 115 which penetrates into the hole portion 111.

The advance and retreat mechanism 113 has a solenoid 116 which serves as a drive unit in which the removal member 112 is coupled to the tip end of a plunger. By turning on this solenoid 116, the removal member 112 is retreated from the rotary disk 41, and by turning off the solenoid 116, the removal member 112 is advanced toward the rotary disk 41 by the pushing force of a spring 117 installed in the plunger.

Further, the advance and retreat mechanism has a sensor (not shown) which detects the rotation position of the rotary disk 41, and a control unit (not shown) which controls drive of the solenoid 116 so that the removal member 112 is advanced to and retreated from the surface 41*a* side of the rotary disk 41 from the hole portion 111 to match a timing of the rotation position of the rotary disk 41 based on the detection of this sensor and only the smaller diameter coins C1 whose outer diameters are out of the handling target range are removed.

The timing at which the removal member 112 is advanced and retreated by the solenoid 116 by the control of the control unit is a timing so as not to be in contact with the coin C whose peripheral edge is brought into contact with and supported by both the feeding projection 52 and the coin support portion 53 and whose outer diameter is within the handling target range but so as to contact with the coin C1 which is brought into contact with and supported by both the feeding projection 52 and the coin support portion 53 and whose outer diameter is a smaller than the handling target range on the premise that the removable member 112 is not in contact with the rotary disk 41 but advanced from the back surface 41*b* side of the rotary disk 41 to the surface 41*a* side and after that retreated to the back surface 41*b* side of the rotary disk 41 through the hole portion 111.

When the rotary disk 41 is rotated in the feeding rotating direction, the solenoid 116 is operated based on the detection of the rotation position of the rotary disk 41, and the removal member 112 is advanced and retreated from the back surface 41*b* side of the rotary disk 41 to the surface 41*a* side through the hole portion 111.

At this time, in a case where the coin C whose outer diameter is within the handling target range is to be brought into contact with both the feeding projection 52 and the coin support portion 53 and moved to the upper region of the rotary disk 41, the removal member 112 is not brought into contact with the coin C, so that the coin C is normally fed out.

On the other hand, in a case where the smaller diameter coin C1 whose outer diameter is out of the handling target range is to be brought into contact with both the feeding projection 52 and the coin support portion 53 of the feeding unit 54 and moved to the upper region of the rotary disk 41, the tip end of the removal member 112 is brought into contact with the coin surface of the smaller diameter coin C1 which faces the rotary disk 41, the smaller diameter coin C1 floats up from the rotary disk 41, and the peripheral edge of the smaller diameter coin C1 is brought away from the feeding projection 52 and the coin support portion 53 and dropped into the storing unit 42, so that the smaller diameter coin C1 is not fed out.

In such a way, the removal member 112 is advanced to and retreated from the surface 41*a* side of the rotary disk 41 by the advance and retreat mechanism 113 from the hole portion 111 provided at the position of the rotary disk 41 which faces the smaller diameter coin C1 whose outer diameter is out of the handling target range moved to the upper region of the rotary disk 41 by the feeding unit 54 upon the rotation of the rotary disk 41, so that the removal member 112 is brought into contact with the smaller diameter coin C1 and the smaller diameter coin C1 can be reliably removed from the feeding unit 54.

It should be noted that the configuration of the removal section 57 applied to this small-diameter removal unit 58 can also be applied to the large-diameter removal unit 101. One solenoid 116 may be shared by the small-diameter removal unit 58 and the large-diameter removal unit 101.

Figure 10:
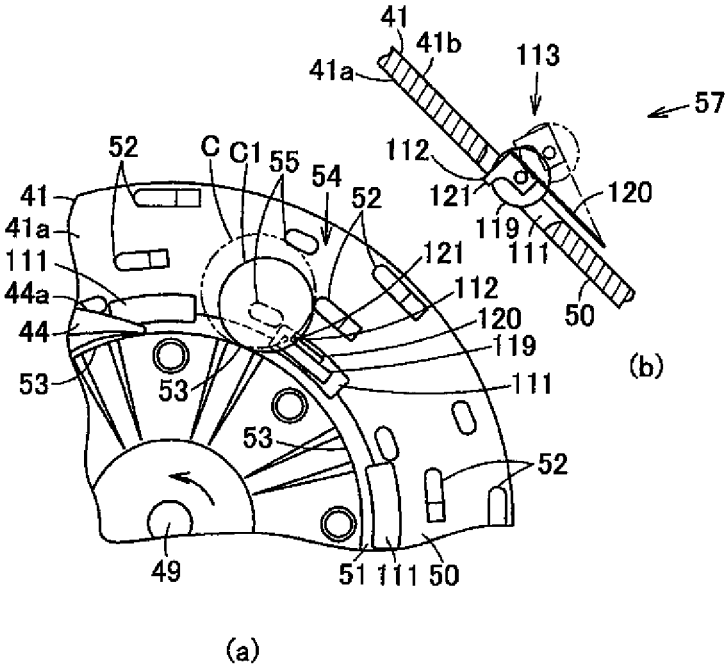
FIG. 10 are the coin feeding machine showing a fourth embodiment of the present invention, FIG. 10(*a*) is a front view of part of the coin feeding machine, and FIG. 10(*b*) is a sectional view in which part of the coin feeding machine is disposed at the position where the part is developed relative to the front view of FIG. 10(*a*).

Next, FIG. 10 show a fourth embodiment.

The removal section 57 has the plurality of hole portions 111 which is provided to penetrate through the rotary disk 41, the removal member 112 which is advanced to and retreated from the back surface 41*b* side of the rotary disk 41 to the surface 41*a* side through the hole portions 111, and the advance and retreat mechanism 113 which advances and retreats this removal member 112, as the small-diameter removal unit 58.

Each of the hole portions 111 is formed between the feeding projection 52 on the respective inner circumferential side and the respective coin support portion 53, includes a region on the outer side of the peripheral edge position of the coin C whose peripheral edge is brought into contact with and supported by both the feeding projection 52 and the coin support portion 53 and whose outer diameter is within the handling target range, and on the inner side of the peripheral edge position of the coin C1 which is brought into contact with and supported by both the feeding projection 52 and the coin support portion 53 and whose outer diameter is a smaller than the handling target range, and is formed in a long hole elongated in the circumferential direction of the rotary disk 41 with the region placed in the middle.

The advance and retreat mechanism 113 has a roller 119, and a support member 120 which rotatably supports this roller 119. The roller 119 is disposed at the position to match the rotation trajectory of the hole portions 111 of the rotary disk 41 in the direction in which the rotating direction matches the rotating direction of the rotary disk 41. The tip end side of the roller 119 and the support member 120 which supports this roller 119 penetrates through the hole portions 111 of the rotary disk 41, so as to be advanced and retreated from the back surface 41*b* side of the rotary disk 41 to the surface 41*a* side. The support member 120 is formed by a plate spring, and the base end side is attached to the fixing part of the base 16 or the like. The support member 120 supports the roller so that the support member 120 is elastically deformed and the roller 119 is brought into contact with the back surface 41*b* of the rotary disk 41, and supports the roller so that the roller 119 comes into the hole portion 111 by the repulsion force against the elastic deformation when the hole portion 111 of the rotary disk 41 faces the roller 119.

The removal member 112 is formed by a projecting portion 121 which protrudes from the tip end side of the support member 120 toward the surface 41*a* side of the rotary disk 41. This projecting portion 121 protrudes from the surface 41*a* of the rotary disk 41 when the roller 119 comes into the hole portion 111 of the rotary disk 41.

The hole portions 111 of the rotary disk 41, the roller 119, the support member 120, and the removal member 112 are formed so that at a timing at which the roller 119 comes into the hole portion 111 from the back surface 41*b* of the rotary disk 41, the projecting portion 121 of the removal member 112 is not brought into contact with the coin C whose peripheral edge is brought into contact with and supported by both the feeding projection 52 and the coin support portion 53 and whose outer diameter is within the handling target range and the projecting portion 121 of the removal member 112 is brought into contact with the smaller diameter coin C1 which is brought into contact with and supported by both the feeding projection 52 and the coin support portion 53 and whose outer diameter is smaller than the handling target range.

When the rotary disk 41 is rotated in the feeding rotating direction, the roller 119 comes into the hole portion 111 from the back surface 41*b* of the rotary disk 41 at every time when the hole portion 111 of the rotary disk 41 reaches the position of the roller 119, and after that, the roller 119 is abutted with the edge portion of the hole portion 111, retreated from the hole portion 111, and brought into contact with the back surface 41*b* of the rotary disk 41.

At this time, in a case where the coin C whose outer diameter is within the handling target range is to be brought into contact with both the feeding projection 52 and the coin support portion 53 and moved to the upper region of the rotary disk 41, the removal member 112 is not brought into contact with the coin C, so that the coin C is normally fed out.

On the other hand, in a case where the smaller diameter coin C1 whose outer diameter is out of the handling target range is to be brought into contact with both the feeding projection 52 and the coin support portion 53 of the feeding unit 54 and moved to the upper region of the rotary disk 41, the removal member 112 is brought into contact with the coin surface of the smaller diameter coin C1 which faces the rotary disk 41, the smaller diameter coin C1 floats up from the rotary disk 41, and the peripheral edge of the smaller diameter coin C1 is brought away from the feeding projection 52 and the coin support portion 53 and dropped into the storing unit 42, so that the smaller diameter coin C1 is not fed out.

In such a way, the removal member 112 is advanced to and retreated from the surface 41*a* side of the rotary disk 41 by the advance and retreat mechanism 113 from the hole portion 111 provided at the position of the rotary disk 41 which faces the smaller diameter coin C1 whose outer diameter is out of the handling target range moved to the upper region of the rotary disk 41 by the feeding unit 54 upon the rotation of the rotary disk 41, so that the removal member 112 is brought into contact with the smaller diameter coin C1 and the smaller diameter coin C1 can be reliably removed from the feeding unit 54.

It should be noted that the configuration of the removal section 57 applied to this small-diameter removal unit 58 can also be applied to the large-diameter removal unit 101.

Although the coin feeding machine 26 provided with the removal section 57 may be applied to all the feeding section 23, the denomination-specific storing/feeding units 24, and the escrow unit 25, at least the coin feeding machine is only required to be applied to the feeding section 23, so that feeding out of the coins whose outer diameters are out of the handling target range input from the outside into the machine to the transport path 17 can be prevented.

Industrial Applicability

The present invention is not limited to a coin depositing and dispensing machine but utilized in machines or the like which handle coins such as a coin depositing machine, a coin dispensing machine, a coin counting machine, and a coin wrapping machine.

REFERENCE SIGNS LIST

11 Coin handling machine
17 Transport path
26 Coin feeding machine
41 Rotary disk
41*a* Surface

42 Storing unit
43 Cover
44 Feeding guide
54 Feeding unit
57 Removal section
58 Small-diameter removal unit
101 Large-diameter removal unit
111 Hole portion
112 Removal member
113 Advance and retreat mechanism
C, C1 Coin

The invention claimed is:

1. A coin feeding machine comprising:

a rotary disk which is rotated at an inclined posture;

a cover which forms a storing unit which stores coins between the cover and the surface of the rotary disk;

a feeding unit which protrudes from the surface of the rotary disk, supports the coins in the storing unit one by one upon rotation of the rotary disk, and moves the coins to an upper region of the rotary disk;

a feeding guide which feeds out of the rotary disk, the coins whose outer diameter is within a handling target range among the coins moved to the upper region of the rotary disk by the feeding unit upon the rotation of the rotary disk; and a removal section which removes from the feeding unit the coins whose outer diameter is out of the handling target range among the coins moved to the upper region of the rotary disk by the feeding unit upon the rotation of the rotary disk, and drops the coins into the storing unit, wherein the removal section has a small-diameter removal unit which protrudes from the surface position of the rotary disk so as not to be in contact with the coins whose outer diameter is within the handling target range, the coins being moved to the upper region of the rotary disk by the feeding unit upon the rotation of the rotary disk, but so as to contact with only the coins whose outer diameter is smaller than the handling target range, and removes the coins whose outer diameter is smaller than the handling target range from the feeding unit by contact with the coins.

2. The coin feeding machine according to claim 1, wherein the removal section has a large-diameter removal unit which is disposed in a peripheral region of the rotary disk so as not to be in contact with the coins whose outer diameter is within the handling target range, the coins being moved to the upper region of the rotary disk by the feeding unit upon the rotation of the rotary disk but so as to contact with only the coins whose outer diameter is larger than the handling target range, and removes the coins whose outer diameter is larger than the handling target range from the feeding unit by contact with the coins.

3. The coin feeding machine according to claim 1, wherein the removal section has a hole portion which is provided at the rotary disk, a removal member which is advanced to and retreated from the surface side of the rotary disk from the hole portion, and an advance and retreat mechanism which advances and retreats the removal member.

4. A coin handling machine comprising:

a transport path which transports coins; and the coin feeding machine according to claim 1 which feeds out the coins to the transport path.

* * * * *